United States Patent [19]

Yoon

[11] Patent Number: 4,926,110

[45] Date of Patent: May 15, 1990

[54] VOLTAGE SWITCHING DEVICE WITH PLURAL FUSES

[75] Inventor: Young R. Yoon, Inchon, Rep. of Korea

[73] Assignee: Daewoo Electronics Co., Ltd., Seoul, Rep. of Korea

[21] Appl. No.: 387,484

[22] Filed: Jul. 28, 1989

[51] Int. Cl.[5] ..... G05F 3/04

[52] U.S. Cl. ..... 323/345; 337/194; 337/259; 337/265; 361/349; 439/621

[58] Field of Search ..... 323/328, 340, 345, 346; 361/349; 363/143, 142; 307/75, 80; 337/255, 256, 257, 258, 259, 194, 197, 198, 206, 265; 439/49, 151, 489, 511, 621, 622

[56] References Cited

U.S. PATENT DOCUMENTS

| | | | |
|---|---|---|---|
| 2,794,094 | 5/1957 | Grant | 337/206 |
| 3,246,103 | 4/1966 | Bellek | 337/206 |
| 3,939,362 | 2/1976 | Grimes et al. | 363/143 |

FOREIGN PATENT DOCUMENTS

| | | | |
|---|---|---|---|
| 50503 | 5/1981 | Japan | 323/340 |

OTHER PUBLICATIONS

"Automatic Selection of Line Voltage Tap for a Power Supply", IBM Tech. Discl. Bul., vol. 28, No. 10, pp. 4372, 3, Mar. 1986.

"Constant Power Fusing Arrangement for 110/220 Volt Power Supply", IBM Tech. Discl. Bul., vol. 31, No. 6, pp. 57, 8, Nov. 1988.

*Primary Examiner*—William H. Beha, Jr.

*Attorney, Agent, or Firm*—Todd A. Dawson; William F. Pinsak

[57] ABSTRACT

A novel voltage switching device operable under a first and a second source voltages is disclosed. The device, which is capable of converting one of the source voltages to the design voltage of an electrical appliance when the two are different, comprises a connector having voltage indicators representing the first and the second voltage switching positions, respectively; and a voltage switching plug having a groove and a pair of fuses for the different source voltages. The connector, in one of the embodiments, may have two pairs of guide slots arranged in a perpendicular relationship between the two pairs. The plug may have a pair of complementary members apt to be selectively engaged with any one pair of the slots when the plug is coupled with the connector. The plug can be accurately coupled with the connector in the first or the second source voltage position based on a simple reading of the corresponding voltage indicator through the groove provided in the cover.

15 Claims, 4 Drawing Sheets

VOLTAGE SWITCHING DEVICE WITH PLURAL FUSES

FIELD OF THE INVENTION

This invention relates to a voltage switching device employed in a home appliance or electronic product so as to operate the latter under different source voltages.

BACKGROUND OF THE INVENTION

In general, most electrical appliances for home use are manufactured to be operable under a specific source or township-supplied voltage.

However, when there is more than one source voltage supplied in a given locality, it becomes necessary to employ a voltage conversion device to operate electrical appliances whenever a source voltage, which is different from their design or operating voltage, is selected.

Therefore, in such a locality, generally provided with an electronic or electrical home product is a voltage conversion device capable of adapting the appliance to the changes in the source voltage.

Accordingly, various voltage switching devices have been disclosed in the prior art which purport to convert from one commercial voltage to another in order to facilitate the use of electronic and electrical products such as TV sets, microwave ovens, refrigerators, electrical tools and the like.

In Korean laid-open utility model publication No. 88-1321, there is provided voltage switching device comprising a first voltage (e.g., 100 V) and a second voltage(e.g., 220 V) fuses included in the internal circuitry of an appliance, wherein one of the fuses is selected by an external switch to convert a given source voltage to another corresponding to the driving voltage of the appliance.

This device is, however, handicapped by the inconvenient requirement of opening the casing of the appliance to gain access to the circuitry in order to check the state of the chosen fuse or remove and replace a broken fuse. Such tasks are not only cumbersome, but also difficult for an average user.

Furthermore, an additional fastening element is required to maintain the switch at a selected position and therefore results in a complicated structure and a greater volume for the switch.

Also, Korean laid-open utility model publication No. 87-19042 discloses a voltage switching device different from the type previously mentioned.

In this type of device, a first voltage and a second voltage fuses are housed in an external switch. Again, such a device is rather inconvenient for an ordinary consumer to handle since he needs to dissemble the switch box to perform the task of checking, placing or replacing a fuse.

SUMMARY OF THE INVENTION

In accordance with the present invention, a novel voltage switching device is provided to facilitate the operation of a home electical or electronic appliance under different source voltages, while solving the problems, as mentioned above, that exist in the prior art apparatus.

It is an object of the present invention to provide an improved voltage switching device for easy use by an average consumer by way of simply coupling a voltage switching plug with a connector at a given orientation of said plug, wherein said orientation is determined based on the source voltage chosen.

It is another object of the present invention to provide an improved voltage switching device having a connector externally and electrically attached to a conventional appliance.

It is a further object of the present invention to provide an improved voltage switching device in which a voltage switching plug is removably and yet firmly connected to the connector.

The above objects of the present invention are accomplished by providing a voltage switching device which comprises a connector having a first and a second voltage indicators, a voltage switching plug containing a first and a second voltage fuses, which is structured to be removably coupled to said connector.

The device further comprises a cover having an appropriate space to accommodate the plug. The cover is preferably made of a transparent material in order to make it easier to detect as to whether or not any of the fuses contained in the plug is broken.

Other and further objects and advantages of the present invention will be apparent from the following description and accompanying drawings which illustrate preferred embodiments of the present invention.

DESCRIPTION OF THE PREFERRED EMBODIMENT

Figure 1A:
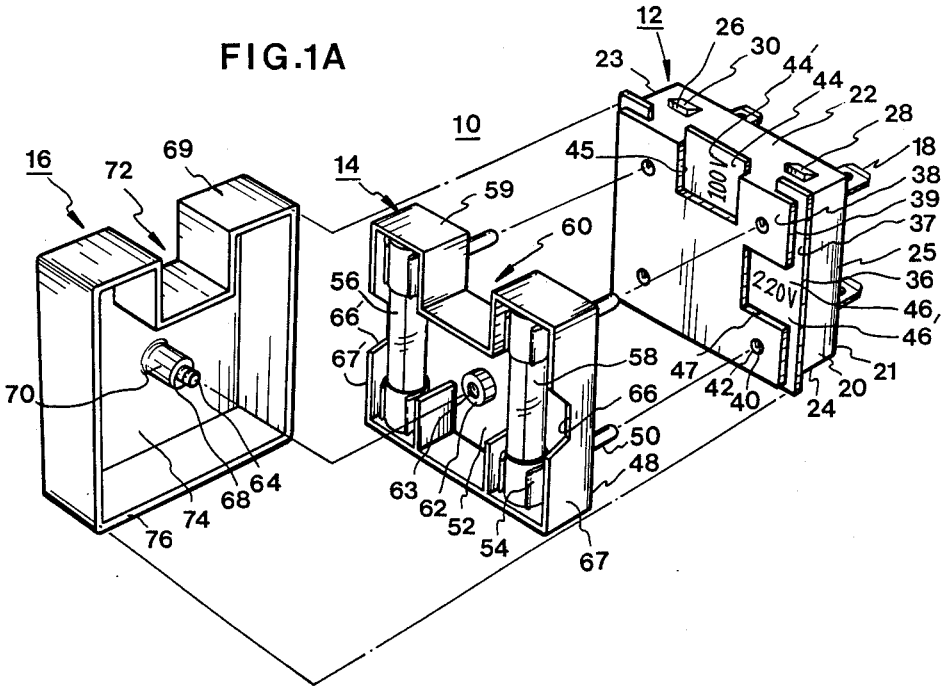
FIG. 1A is a partially exploded perspective view showing the device in which the voltage switching plug is oriented toward the connector in a first source voltage switching position, i.e., 100 V, according to a preferred embodiment of the present invention.

Referring now to FIG. 1A, there is shown a voltage switching device which is generally designated by the numeral 10 and comprises a connector 12 that may be externally and electrically attached to the casing of a conventional electrical appliance (FIG. 2), a voltage switching plug 14 apt to be coupled with the connector 12, and a cover 16 having an appropriate space to house the plug 14 therein.

The connector 12 comprises a body 20 having four conductive terminals 18 extending substantially forward from the front side 21 of the body and also arranged in a symmetrical and parallel relationship with each other. Each of the terminals 18 is electrically connected to each of the terminals in the voltage conversion circuit 200 which exists in the internal circuitry of the appliance (shown in FIGS. 5A, 5B), when the connector 12 is mounted on the casing 32 of the appliance as will be described more fully hereinbelow.

Figure 2:
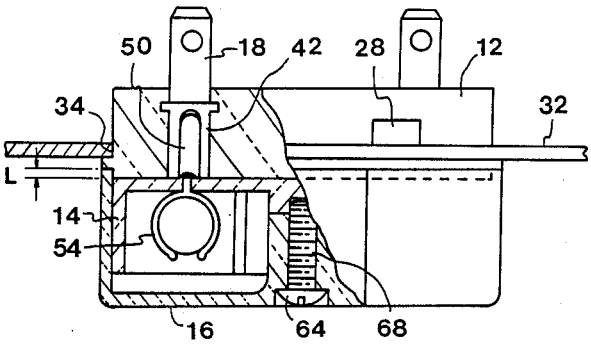
FIG. 2 is a partial cutaway view of the novel switching device having all the respective members shown in FIG. 1A assembled when it is attached to the casing of a conventional appliance.

The body 20 comprises one or more lugs 26,28, which may be provided on any one or more of the peripheral faces of the body, and preferably provided on the upper and the lower faces 22,24 thereof and each having a smoothly tapered surface 30. Such lugs having the tapered surface 30 allow the connector 12 to be engaged with the opening 34 of the casing 32 in a locked position as shown in FIG. 2.

A projecting flange 36, located close to the rear portion 38 of the body 20, extends slightly outwardly around the peripheral faces and also is appropriately spaced from the lugs 26,28.

By way of designing the distance between the lugs 26,28 and the flange 36 to be substantially identical to the thickness of the casing 32, it is possible to have the connector 12 firmly engaged in the opening 34, once it has been inserted therein.

Located in the body 20 are four pin receiving holes 40 corresponding to the respective terminals 18. Also, secured to the inner surfaces of each of the pin receiving holes 40 is a conductive piece 42 which is electrically connected to each of the respective terminals 18.

Additionally, provided on the rear portion 38 of the body are two voltage indicators 44,46 arranged in a perpendicular angle against each other and shaped a rectangularly. Preferably, the depth of the respective recesses 45,47 is substantially the same as the distance between the back face of the rear portion 38 and the projecting flange 36.

Furthermore, written on the respective indicators 44,46 are the appropriate characters 44',46' which indicate a first and a second voltages (e.g., 100 V and 220 V) to guide the proper orientation of the plug 14, prior to its coupling with the connector 12, according to the level of the source voltage, chosen as further described hereinbelow.

Referring now to FIG. 1A, the voltage switching plug 14 is selectively coupled with the connector 12 in the first or the second voltage switching position or orientation depending on the source voltage selected.

The plug has four conductive pins 50 extending forward from the front face 48 thereof and arranged in a parallel relationship with each other so as to correspond to the respective pin receiving holes 40.

When the plug 14 is coupled with the connector 12, therefore, the respective pins 50 are to come into contact with the respective conductive pieces 42 in the pin receiving holes 40 to thereby be electrically connected to the respective terminals 18.

Additionally, a backwardly opened space 52 is provided at the rear portion of the plug 14. Also provided at the rear side of the plug are two pairs of fuse holders 54 which are secured to the respective pins 50 by means of caulking operation(shown in FIG. 2).

The left side fuse 56 which corresponds to a first source voltage, e.g., 100 V, and the right side fuse 58 which corresponds to a second source voltage, e.g., 220 V, are removably inserted in the respective fuse holders 54. In order to facilitate the removal and replacement of the fuses 56,58 for repair, a pair of notches 66,66' are provided in both longitudinal sides 67,67' of the plug 14.

Formed at the upper side of the plug 14 is a rectangularly shaped groove 60 to correspond to the recess 44 or 46 of the connector 12 when the plug 14 is coupled with the connector. In this connection, the cross-section area of the groove 60 is preferably identical to that of the recess 45 or 47 of the connector 12. If the plug 14 is coupled with the connector 12 in the arrangement as shown in FIG. 1A, the indicator 44, which reads the first voltage(e.g., 100 V) 44', can be seen through the groove 60 of the plug 14, while the indicator 46, which shows the second voltage(e.g., 220 V) 46', becomes hidden behind the front face 48 of the plug 14.

The plug 14 includes a centrally protruding portion 62 having a threaded hole 63 therein.

As best shown in FIG. 1A, the cover 16 has an appropriate space 74 for accommodating the plug 14 therein. The cover 16 also includes a centrally protruding portion 69 corresponding to the protruding portion 62 of the plug 14 and having a threaded hole 68 therein. Therefore, the cover 16 can be coupled with the plug 14 by means of a screw 64 through the corresponding holes 63,68.

In addition, provided at the upper side 69 of the cover 16 is a rectangularly shaped groove 72 that is substantially similar to that (60) of the plug 14. Thus, through these two grooves 60, 72, one of the voltage indicators 44, 46 is selectively to be seen when the plug 14 housed in the cover 16 is coupled with the connector 12 in one of the voltage switching positions.

Also, the cover 16 has a peripheral extension extending uniformly forward beyond the front face 48 of the plug 14 when the plug 14 is fully engaged within the cover 16 by means of the screw 64 (see FIG. 2).

Preferably, the length L of such extension 76 is substantially the same as the distance between the projecting flange 36 and the back face of the rear portion 38 of the body as previously described.

Therefore, when the plug 14 housed in the cover 16 is coupled with the connector 12, the outer extension 76 of the cover 16 is engaged in close contact with one of the recesses 45,47 and peripheral faces 39 of the rear portion 38. As a result, the plug 14 can be firmly attached to the connector 12.

The cover is preferably made of a transparent material for an easy detection of the breakage of the fuses 56,58.

FIG. 2 shows a partial sectional view of the casing 32 and the respective component parts as assembled. In general, each of the respective terminals 18 is electrically connected to each of the terminals provided in the voltage conversion circuit (FIGS. 5A, 5B) as mentioned above.

Referring now to FIGS. 1A, 1B and FIGS. 5A, 5B, the operation of the present invention will be explained, for the sake of convenience, under the assumption that the electrical appliance is designed and built to be driven under the second voltage (e.g., 220 V).

Figure 5A:
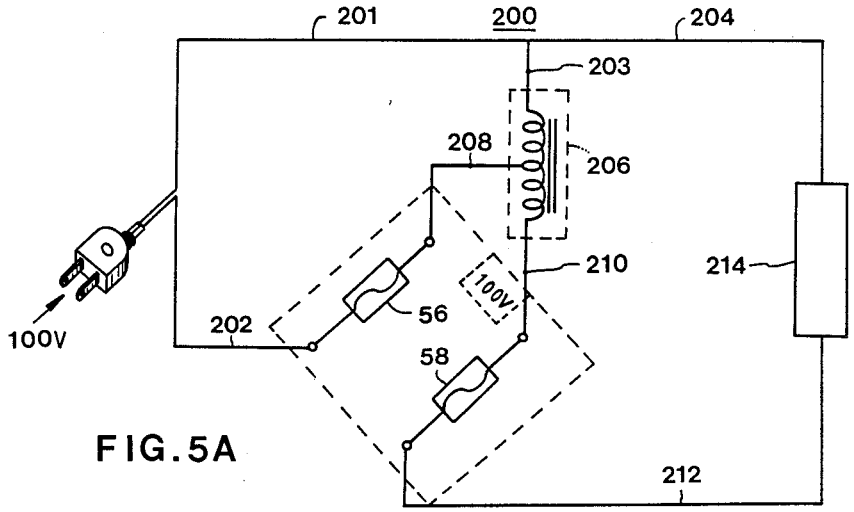
FIGS. 5A and 5B schematically show typical electrical circuits that may be applicable to the device of the present invention.

If the source voltage is, for example, the first voltage (e.g., 100 V) as shown in FIG. 5A, then it is converted into the second voltage (e.g., 220 V) through the voltage conversion circuit (200) by coupling the plug 14 with the connector 12 in the first source voltage position or orientation where the voltage indicator 44 having the first voltage indicating character 44' is shown through the groove 72 of the cover 16.

In this circuit 200, one end terminal 203 of the transformer 206 is commonly connected to one input line 201 from AC source and one end 204 of a load 214.

Two of the terminals 18 of the connector 12 are connected to the other input line 202 from AC source and a tap terminal 208 of the transformer 206, respectively.

Also, the other two of the terminals 18 are connected to the other end terminal 210 of the transformer 206 and the other end 212 of the load 214, respectively.

In such connection of the connector 12 to the circuit 220, if the plug 14 is coupled with the connector 12 in the first voltage position as previously described, the first voltage(e.g., 100 V) from AC source will be supplied to the transformer 206 through the fuse 56 for the first voltage and stepped up at the transformer 206, and then the stepped-up voltage(e.g., 220 V) will be applied to the load 214 through the fuse 58.

Figure 1B:
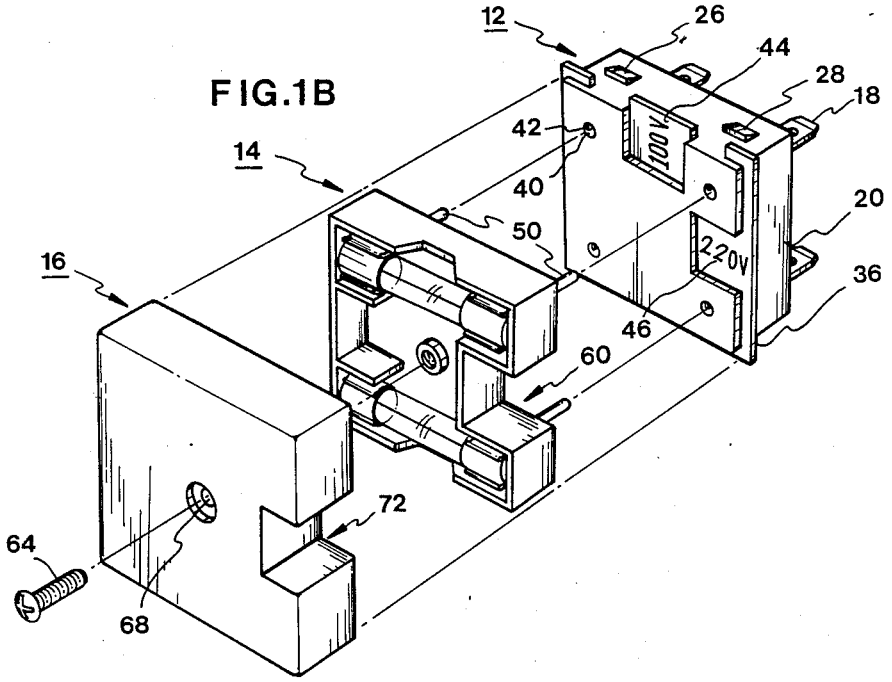
FIG 1B is a partially exploded perspective view showing the device in which the voltage switching plug is oriented toward the connector in a second source voltage switching position, i.e., 220 V, according to a preferred embodiment of the present invention.
Figure 5B:
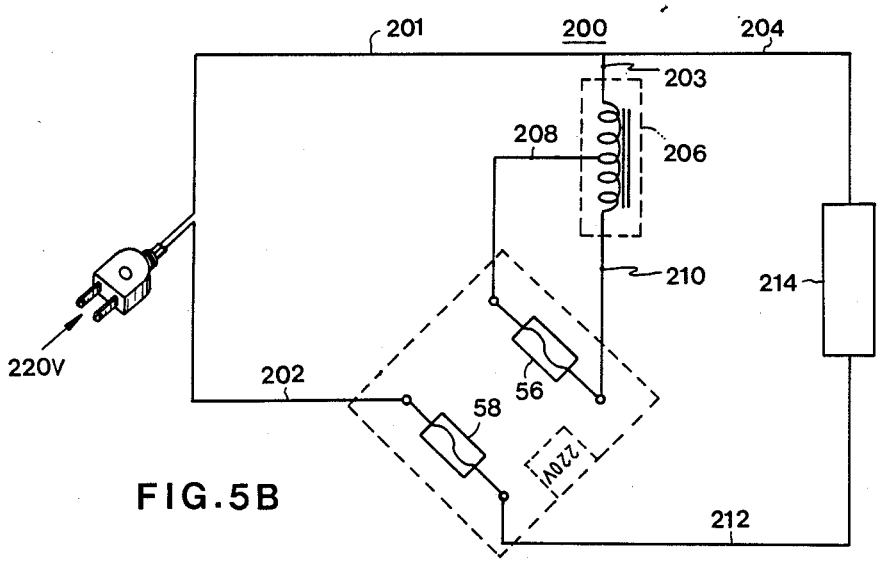

Referring now to FIGS. 1B and 5B, if the source voltage is the second voltage (e.g., 220 V), then it will be directly applied to the load 214 without the voltage conversion through the fuse 58. At this time, the plug 14 will be coupled with the connector 12 in the second voltage position or orientation where the voltage indicator 46 having the second voltage character 46' is shown through the groove 72 of the cover 16.

Figure 3A:
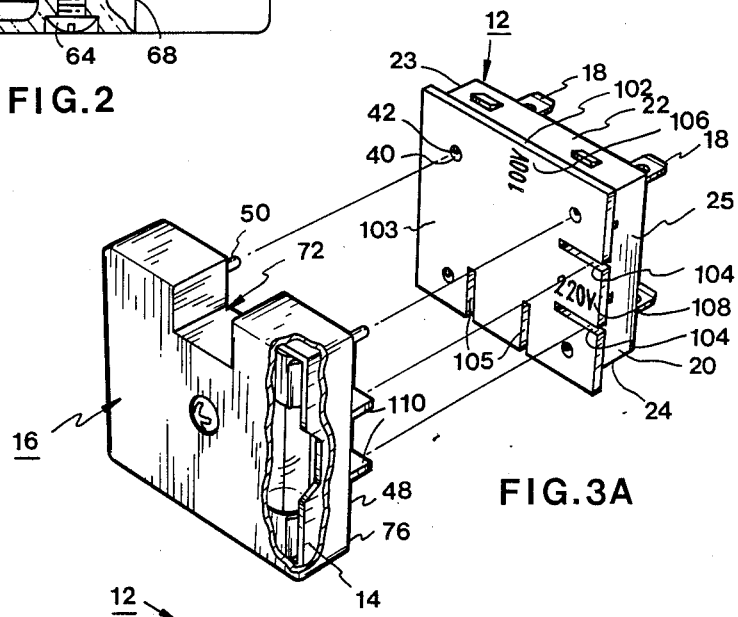
FIG. 3A is a partially exploded perspective view, similar to FIG. 1A, of an alternative embodiment of the present invention.
Figure 3B:
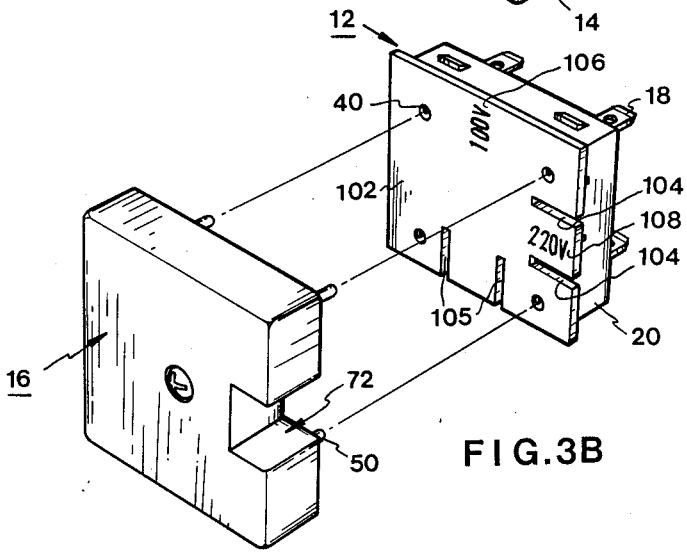
FIG. 3B is a partially exploded perspective view, similar to FIG. 1B, of an alternative embodiment of the present invention.

An alternative embodiment of FIGS. 3A,3B is similar to the one described above with an exception: that is, the means for coupling the plug 14 with the connector 12. Therefore, like parts which correspond to the elements of the previous embodiment are represented with like reference numerals.

In this embodiment, the connector 12 comprises a body 20 having four conductive terminals 18 and a flat flange 102 which is integrally formed in the back side of the body 20 and which extends appropriately outwardly beyond the peripheral faces 22–25 of the body 20.

As can be seen in FIGS. 3A,3B, instead of the recesses 45,47 of the previous embodiment, the connector 12 has two sets of a pair of closely spaced parallel guide slots 104,105 penetrating forward through the flange 102 up to a portion of the body 20. One pair of guide slots 104 is disposed substantially perpendicular to the other pair of guide slots 105.

As illustrated in FIGS. 3A,3B, written on the back side 103 of the flange 102 are the voltage indicating characters 106,108 which represent the first and the second voltages (e.g., 100 V, 220 V), respectively.

The respective characters 106,108 are located on the flange 102 in a perpendicular relationship. Corresponding to one pair of the guide slots 104,105, a pair of elongated complementary members 110 are projected forward from the front face 48 of the plug 14.

When the plug 14 is coupled with the connector 12 in the first or the second voltage position or orientation, therefore, the complementary members 110 are engaged with one pair of the guide slots 104,105, and thus the plug 14 is firmly held in the connector 12.

This embodiment is structured further differently from the previous one in that the outer extending periphery 76 of the cover 16 is constructed to substantially lie coplanar with the front face 48 of the plug 14 when the plug 14 is fully engaged with the cover 16.

Referring now to FIGS. 3A and 5A, if the source voltage is a first voltage (e.g., 100 V), the plug 14 will be coupled with the connector 12 such that the first voltage indicating character 106 may be shown through the groove 72 of the cover 16. At this time, the source voltage is converted to the second voltage(e.g., 220 V) via the circuit 200 and the converted voltage is applied to the load 214 as previously described.

Referring now to FIGS. 3B and 5B, if the source voltage is a second voltage (e.g., 220 V), the plug 14 will be oriented and coupled in the second voltage position relative to the connector 12 so that the second voltage indicating character 108 is shown through the groove 72 of the cover 16. In this case, the source voltage is directly applied through fuse 58 to the load 214 without the voltage conversion, as previously described.

Figure 4A:
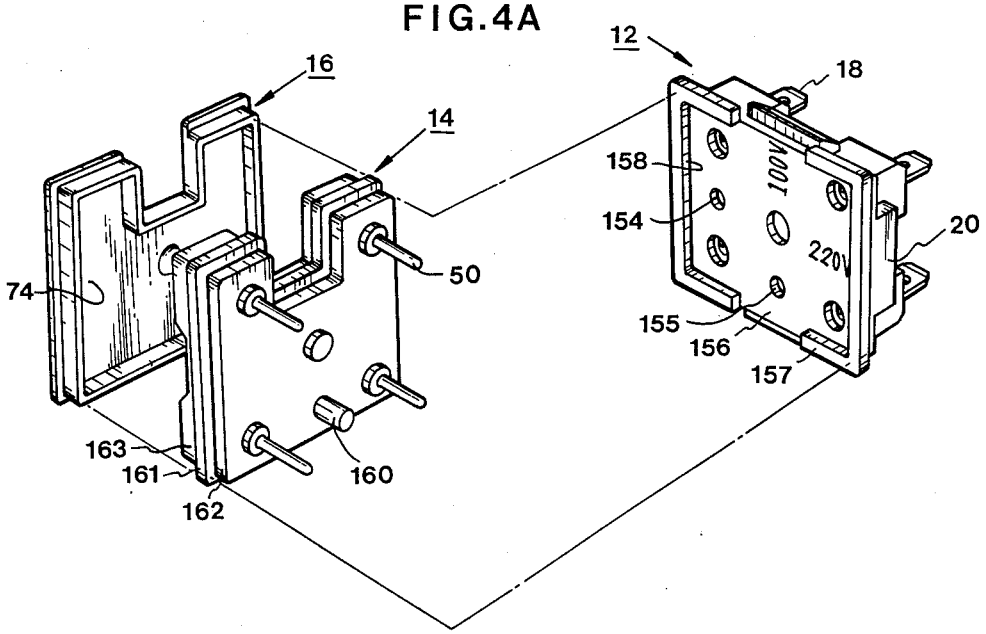
FIGS. 4A and 4B are partially exploded perspective views, similar to FIGS. 3A and 3B, of another embodiment of the present invention.
Figure 4B:
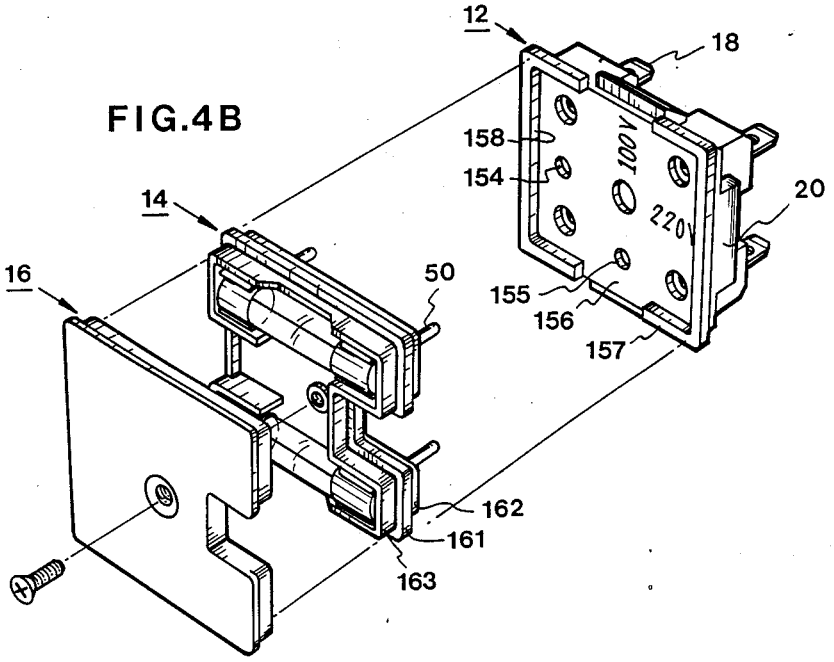

FIGS. 4A and 4B show a third embodiment similar to the second one shown in FIGS. 3A and 3B. In this embodiment, the following descriptions in the third embodiment will be confined to major differences from the second one.

As can be seen in FIGS. 4A and 4B, instead of two sets of closely spaced parallel guide slots 104, 105, the connector 12 has two guide holes 154, 155 arranged in a substantially perpendicular relationship with each other in a flange 156 and the body 20. The flange 156 of the connector 12 has a rim 157 extending uniformly backward from its peripheral edge and thus defining a suitable recess 158 to accommodate at least a portion of the plug therein.

The plug 14 has an elongated rod 160 being selectively engaged within any one of the guide holes 154, 155 and also has a flange 161 located near the middle portion of the peripheral face thereof and extending outwardly around the peripheral face. When the plug 14 is coupled with the connector 12, a front portion 162 of the plug 14 is seated in the recess 158 of the connector 12. When the plug 14 is covered with the cover 16, a rear portion 163 of the plug 14 is housed within the space 74 of the cover 16. Preferably, the thickness of the front portion 162 is substantially the same as the depth of the recess 158 of the connector 12 and the thickness of the rear portion 163 is the same as the depth of the space 74 of the cover 16.

Although this invention has been shown and described with respect to the preferred embodiments, it will be understood by those skilled in the art that certain changes and modifications may be made without departing from the spirit and scope of the invention as defined in the following claims.

What is claimed is;

1. A voltage switching device operable under a first and a second source voltages which comprises:

a connector including a body having four conductive terminals extending substantially forward in a symmetrical and parallel relationship from the front face of the body, a projecting flange extending slightly outwardly beyond the periphery of the body and positioned adjacent to the rear portion of the body, a plurality of conductive pieces secured to the internal surfaces of four pin receiving holes located in the body and corresponding to said conductive terminals, and a pair of voltage indicators having recesses located on the rear portion of the body and arranged in a perpendicular direction relative to each other;

a voltage switching plug including four conductive pins extending forward from the front face thereof and apt to be engaged in the respective pin receiving holes located in the body of the connector, a plurality of fuse holders secured to the respective pins, and a groove located at the upper portion of the plug and corresponding to one of the voltage indicators when the plug is selectively coupled with the connector in the first or the second selected voltage position;

a cover including a groove corresponding to said groove located in the plug, and a suitable space to accommodate the plug therein; and fastening means for securing the plug inside the cover.

2. The device as set forth in claim 1 wherein said body comprises one or more lugs provided on any one or more of the peripheral faces thereof and appropriately spaced from the projecting flange and downwardly tapered toward the front face thereof.

3. The device as set forth in claim 1 wherein said respective indicators comprise two different voltage indicating characters which represent the first and the second source voltage switching positions, respectivly.

4. The device as set forth in claim 1 wherein said fuse holders retain a pair of fuses for the first and the second voltages, respectively.

5. The device as set forth in claim 1 wherein said plug includes a pair of notches formed along the longitudinal sides thereof.

6. The device as set forth in claim 1 wherein said cover is made of a transparent material.

7. A voltage switching device operable under a first and a second source voltages which comprises:

a connector including a body having four conductive terminals extending substantially forward in a symmetrical and parallel relationship from the front face of the body, a flat projecting flange integrally formed in the back side of the body and extending slightly outwardly beyond the periphery of the body wherein said flange has a pair of voltage indicators arranged substantially in a perpendicular direction relative to each other and has two different voltage indicating characters which represent the first and the second source voltage switching positions, respectively, a plurality of conductive pieces secured to the internal surfaces of four pin receiving holes located in the flange and the body and corresponding to said conductive terminals, and first and second guide means penetrating forward through the flange and up to a portion of the body with each of the guide means disposed in a perpendicular direction relative to each other; and a voltage switching plug including four conductive pins extending forward from the front face thereof and apt to be engaged in the respective pin receiving holes, a plurality of fuse holders secured to the respective pins, a groove located at the upper portion of the plug and corresponding to one of the voltage indicators when the plug is selectively coupled with the connector, and complementary means extending forward from the front face of the plug and apt to be engaged with the first or the second guide means when the plug is selectively coupled with the connector at the first or the second source voltage position.

8. The device as set forth in claim 7 wherein each of said first and second guide means comprises a pair of closely spaced parrallel guide slots and said complementary means comprises a pair of elongated members.

9. The device as set forth in claim 7 wherein each of said first and second guide means comprises one guide hole and said complementary means comprises one elongated rod.

10. The device as set forth in claim 7 wherein said flange of the connector has a rim extending uniformly backward from its peripheral edge and thus defining a suitable recess to accommodate at least a portion of the plug therein.

11. The device as set forth in claim 7 wherein said body comprises one or more lugs provided on any one or more of the peripheral faces thereof and appropriately spaced from the projecting flange and downwardly tapered toward the front face thereof.

12. The device as set forth in claim 7 wherein said fuse holders retain a pair of fuses for the first and the second voltages, respectively.

13. The device as set forth in claim 7 wherein said plug includes a pair of notches formed along the longitudinal sides thereof.

14. The device as set forth in claim 7 further comprising a cover having a groove corresponding to said groove located in the plug and a suitable space to accommodate the plug therein and fastening means for securing the plug inside the cover.

15. The device as set forth in claim 14 wherein said cover is made of a transparent material.

* * * * *

UNITED STATES PATENT AND TRADEMARK OFFICE

CERTIFICATE OF CORRECTION

PATENT NO. : 4,926,110

DATED : May 15, 1990

INVENTOR(S) : Young R. Yoon

It is certified that error appears in the above-identified patent and that said Letters Patent is hereby corrected as shown below:

On the title page:

Item [30] Foreign Application Priority data August 2, 1988
[KR] Rep of Korea.....9856/1988

Signed and Sealed this

Sixteenth Day of February, 1993

*Attest:*

STEPHEN G. KUNIN

*Attesting Officer*

*Acting Commissioner of Patents and Trademarks*